US011603675B2

(12) United States Patent
Nichols

(10) Patent No.: US 11,603,675 B2
(45) Date of Patent: Mar. 14, 2023

(54) DEVICES, SYSTEMS AND METHODS RELATING TO ROOF STANDING SEAM ANCHORS

(71) Applicant: Steven Christopher Nichols, Duvall, WA (US)

(72) Inventor: Steven Christopher Nichols, Duvall, WA (US)

( * ) Notice: Subject to any disclaimer, the term of this patent is extended or adjusted under 35 U.S.C. 154(b) by 0 days.

(21) Appl. No.: 17/157,607

(22) Filed: Jan. 25, 2021

(65) Prior Publication Data

US 2022/0056716 A1 Feb. 24, 2022

Related U.S. Application Data

(60) Provisional application No. 62/965,111, filed on Jan. 23, 2020.

(51) Int. Cl.
*E04G 21/32* (2006.01)
*A62B 35/00* (2006.01)

(52) U.S. Cl.
CPC ..... *E04G 21/3285* (2013.01); *A62B 35/0068* (2013.01)

(58) Field of Classification Search
CPC ..... E04G 21/3285; E04G 21/3276; A62B 35/0068; A62B 35/0043; A62B 35/005; A62B 35/0056; A62B 35/0062
See application file for complete search history.

(56) References Cited

U.S. PATENT DOCUMENTS 3,880,405 A * 4/1975 Brueske ..... E04G 21/3285 248/237
5,687,535 A * 11/1997 Rohlf ..... E04D 13/12 52/27
5,694,720 A * 12/1997 Walcher ..... E04G 5/045 52/703
6,688,047 B1 * 2/2004 McNichol ..... E04D 13/10 52/25
7,240,770 B2 * 7/2007 Mullins ..... E04G 21/3276 52/24
7,703,256 B2 * 4/2010 Haddock ..... F16B 2/10 52/24

(Continued)

FOREIGN PATENT DOCUMENTS

AT 509330 A4 * 8/2011 ..... E04G 21/3261
CH 704527 A1 * 8/2012 ..... A62B 35/0068

(Continued)

*Primary Examiner* — Eret C McNichols
(74) *Attorney, Agent, or Firm* — King IP Law; Joshua King

(57) ABSTRACT

Systems, devices and methods, etc., comprising anchors configured to attach to standing seams such as those typically present on metal roofs. The systems, etc., provide benefits such as improved anchorage points for personal fall protection anchorage devices and variability of and security of attachment to the standing seams. The personal fall protection anchorage devices can comprise a retention plate configured to hold the personal fall protection device to a central portion of the retention plate and having at least two y-axis spaced-apart slot configured to immobily hold opposed standing seam graspers each comprising at least two opposed grasping elements sized and configured to immobily squeeze standing seams of the metal roof.

11 Claims, 7 Drawing Sheets

(56) References Cited

U.S. PATENT DOCUMENTS 8,070,119 B2 * 12/2011 Taylor ..... E04G 21/3276 248/229.23
8,424,638 B1 * 4/2013 Guthrie ..... E04G 21/3276 248/499
8,732,917 B2 * 5/2014 Zeilenga ..... E04G 21/3285 52/24
8,769,911 B2 * 7/2014 Montgomery ..... E04G 21/3261 52/705
8,910,928 B2 * 12/2014 Header ..... F16B 2/065 52/24
9,878,187 B2 * 1/2018 Sargent ..... E04G 21/328
10,948,002 B2 * 3/2021 Haddock ..... F16B 2/10
11,213,704 B2 * 1/2022 Smith ..... A62B 35/0068
2002/0088196 A1 * 7/2002 Haddock ..... E04G 21/3285 52/24
2006/0096238 A1 * 5/2006 Mullins ..... E04G 21/3276 52/749.12
2007/0022702 A1 * 2/2007 Lallier ..... E04G 3/26 52/698
2007/0144830 A1 * 6/2007 Mastenbroek ..... A62B 35/0068 182/3
2010/0133040 A1 * 6/2010 London ..... E04G 21/3261 182/3
2012/0032045 A1 * 2/2012 Lallier ..... E04G 3/26 248/237
2013/0167470 A1 * 7/2013 Montgomery ..... E04G 21/3261 24/519
2013/0313043 A1 * 11/2013 Lallier ..... E04G 3/265 248/237
2014/0224579 A1 * 8/2014 Balascak ..... E04G 21/3223 182/3
2015/0060620 A1 * 3/2015 Smeja ..... E04D 13/00 248/237
2015/0107184 A1 * 4/2015 Nichols, Jr. ..... E04B 7/18 52/698
2016/0222670 A1 * 8/2016 Bond ..... E06C 1/345
2017/0157438 A1 * 6/2017 Sargent ..... E04G 21/328
2019/0366134 A1 * 12/2019 Smith ..... E04G 21/3214
2021/0285244 A1 * 9/2021 Allen ..... E04G 21/3276

FOREIGN PATENT DOCUMENTS

DE 102018122144 A1 * 4/2020
EP 0952272 A1 * 10/1999
EP 1568830 A2 * 8/2005 ..... E04D 13/10
FR 2832751 A1 * 5/2003 ..... A62B 35/0068
JP 2000045536 A * 2/2000
NL 2009550 C * 4/2014 ..... E04G 21/3285
WO WO-2013132367 A1 * 9/2013 ..... E04G 21/3285

* cited by examiner

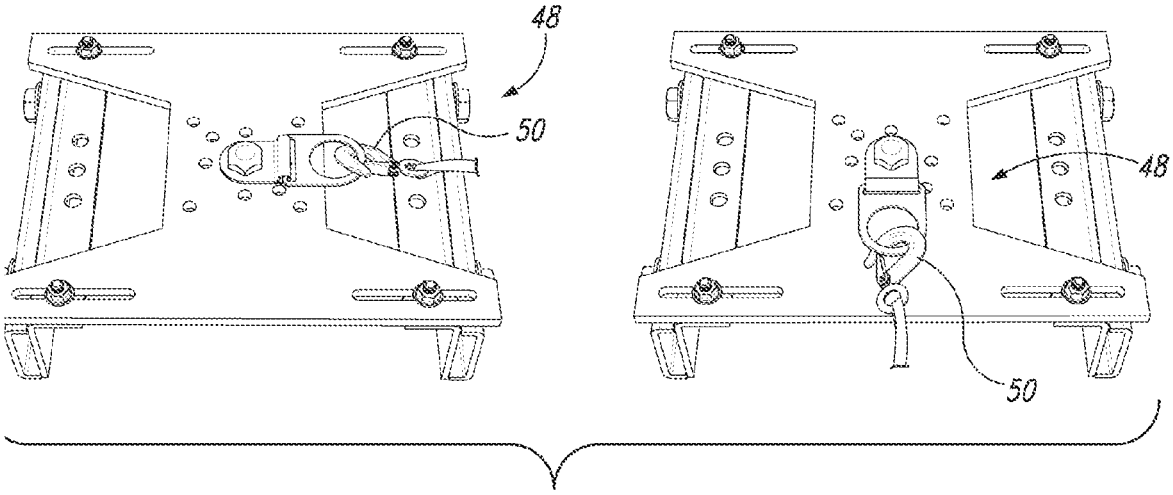
Fig. 11
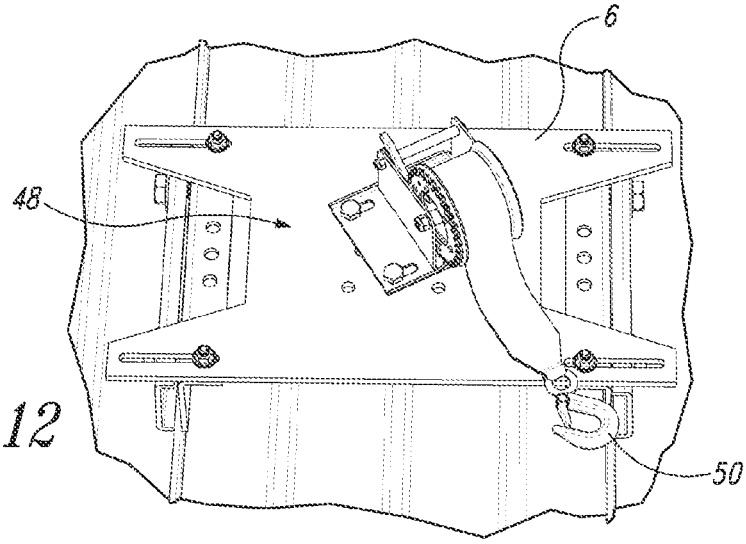
Fig. 12
Fig. 13
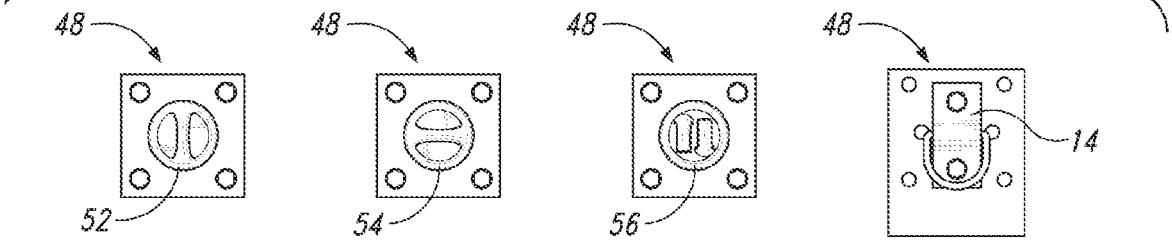

DEVICES, SYSTEMS AND METHODS RELATING TO ROOF STANDING SEAM ANCHORS

BACKGROUND

Standing seam metal panels used for roofing pose a unique challenge for attaching personal fall protection anchorage devices such as those required by the US Dept. of Labor (OSHA). Such personal fall protection anchorage devices can be used as tie-off points for workers exposed to fall hazards. Typical personal fall protection anchorage devices, such as those used in residential and commercial buildings/structures, are attached directly to an engineered structural component of the building or are surface mounted to the exterior of the building. These types of anchorage devices may be integrated as permanent fixtures of the building by waterproofing the anchor's penetration through the roofing membrane, but this can be expensive and time-consuming. Further, even if properly waterproofed they still present a future leak hazard. Metal panel roofing systems can be fitted with permanently installed anchorage devices, but there is a need for anchors that do not penetrate the metal panels, and can be installed either permanently or temporarily at the option of the user, so that such anchors can if desired be removed after use. An additional benefit not currently found are anchors that do not damage or significantly alter (e.g., penetrate) the metal roofing surface(s) and its seams.

The present systems, devices and methods, etc., provide these and/or other advantages.

SUMMARY

The present systems, devices and methods, etc., provide anchors configured to attach to standing seams such as those typically present on metal roofs. The systems, etc., provide such benefits as improved anchorage points for personal fall protection anchorage devices and variability of and security of attachment to the standing seams. FIGS. 1A and 1B depict views of typical metal roofing and standing seams.

In some aspects, the present systems, devices and methods, etc., provide roof attachment systems configured for attaching a personal fall protection anchorage device to at least two standing seams on a roof, the roof attachment system can comprise:

- a retention plate configured to hold the personal fall protection anchorage device to a central portion of the retention plate and having an x-axis and a y-axis wherein the x-axis runs the same direction as the standing seams and the y-axis runs transverse to the standing seams, the retention plate further can comprise at least two y-axis spaced-apart slots, each y-axis spaced-apart slot configured to immobily hold a retention plate connector attached to a standing seam grasper, each y-axis spaced-apart slot configured to immobily hold the retention plate connector at a plurality of locations within the slot;
- at least two of the retention plate connectors configured to immobily attach at least one standing seam grasper to the retention plate via the y-axis spaced-apart slots;
- at least two of the standing seam graspers each can comprise at least two opposed grasping elements sized and configured to immobily squeeze a standing seam of a roof.

The retention plate can comprise a D-ring configured to hold the personal fall protection anchorage device. The at least two y-axis spaced-apart slots each comprise a pair of sub-slots, each configured to slidingly receive a single retention plate connector attached to a standing seam grasper. The retention plate can be H-shaped and the at least two y-axis spaced-apart slots can be located in the legs of the H-shape.

The retention plate connectors can comprise nuts and bolts. The at least two standing seam graspers each comprise a) an L-shaped element wherein a first leg of the L-shape abuts the retention plate and a second leg of the L-shape can be configured to abut the standing seam, and b) a squeezing element spaced apart from the first leg such that the L-shaped element and the squeezing element can be sized and configured to immobily squeeze the standing seam between them. The squeezing elements can comprise a shallow U-shape can comprise a central portion and two legs extending therefrom, and the squeezing element can be disposed such free ends of the two legs contact the L-shaped element and/or the standing seam.

In some further embodiments, the systems, etc., herein provide personal fall protection system configured for attaching a personal fall protection anchorage device to a roof, the personal fall protection system can comprise the roof attachment systems herein and further comprise at least two standing seams of the roof immobily held within the opposed grasping elements. The roof can be a metal roof, and the personal fall protection system further can comprise a personal fall protection anchorage device attached to the roof attachment system.

Methods herein including manufacturing and/or using the roof attachment systems herein as well as the personal fall protection systems herein.

These and other aspects, features and embodiments are set forth within this application, including the following Detailed Description and attached drawings. Unless expressly stated otherwise, all embodiments, aspects, features, etc., can be mixed and matched, combined and permuted in any desired manner.

BRIEF DESCRIPTION OF THE DRAWINGS

FIG. 11 depicts a top perspective view of an exemplary roof attachment system as discussed herein with an exemplary personal protection equipment anchor and lifeline attached.

FIG. 12 depicts a top perspective view of an exemplary roof attachment system as discussed herein with an alternative exemplary personal protection equipment anchor and lifeline attached.

FIG. 13 depicts a top plan view of exemplary personal protection equipment (PPE) anchors suitable for use with the roof attachment systems as discussed herein.

DETAILED DESCRIPTION

Figure 1A:
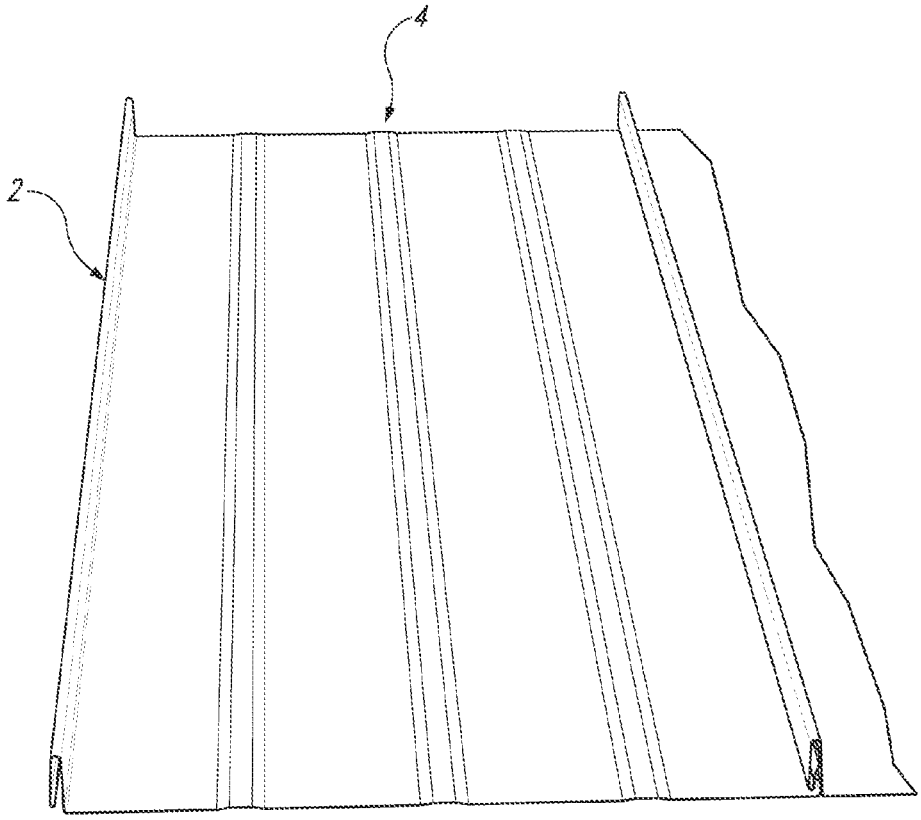
FIGS. 1A and 1B depict typical standing seams including, in FIG. 1B some typical dimensions for such standing seams.
Figure 1B:
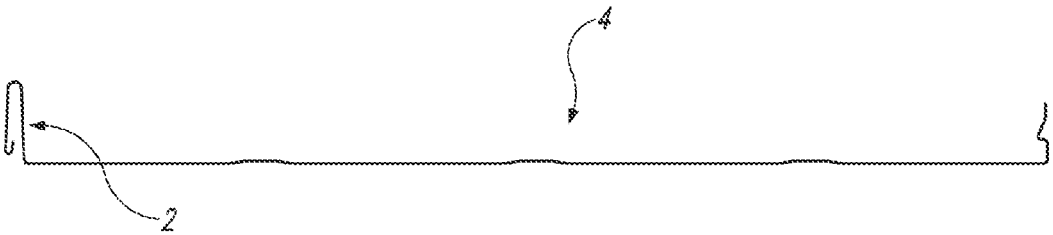

The present systems, devices and methods, etc., provide anchor platforms that can be moved along and securely, immobily attached attach to standing seams on a roof such as those typically present on metal roofs, although the systems can be used with any roof having suitable standing seams, such as standing ridges, that can securely receive the roof attachment system. FIGS. 1A and 1B depict views of typical metal roofing 4 and standing seams 2. Such attachment is strong enough to withstand the rigors of an attached worker falling off the roof and other issues encountered in assuring personnel safety. The anchor platforms comprise retention plates configured to anchor, adequately for fall-protection purposes, personal fall protection devices as well as devices such as D-rings or anchor posts comprising attachment points for such personal fall protection devices. The systems, etc., provide benefits such as improved anchorage points for personal fall protection anchorage devices and variability of and security of attachment to the standing seams such as those below:

The present systems, devices and methods, etc., comprise anchor platforms as a part of roof attachment systems that attach to standing seams such as those typically present on metal roofs.

Figure 2:
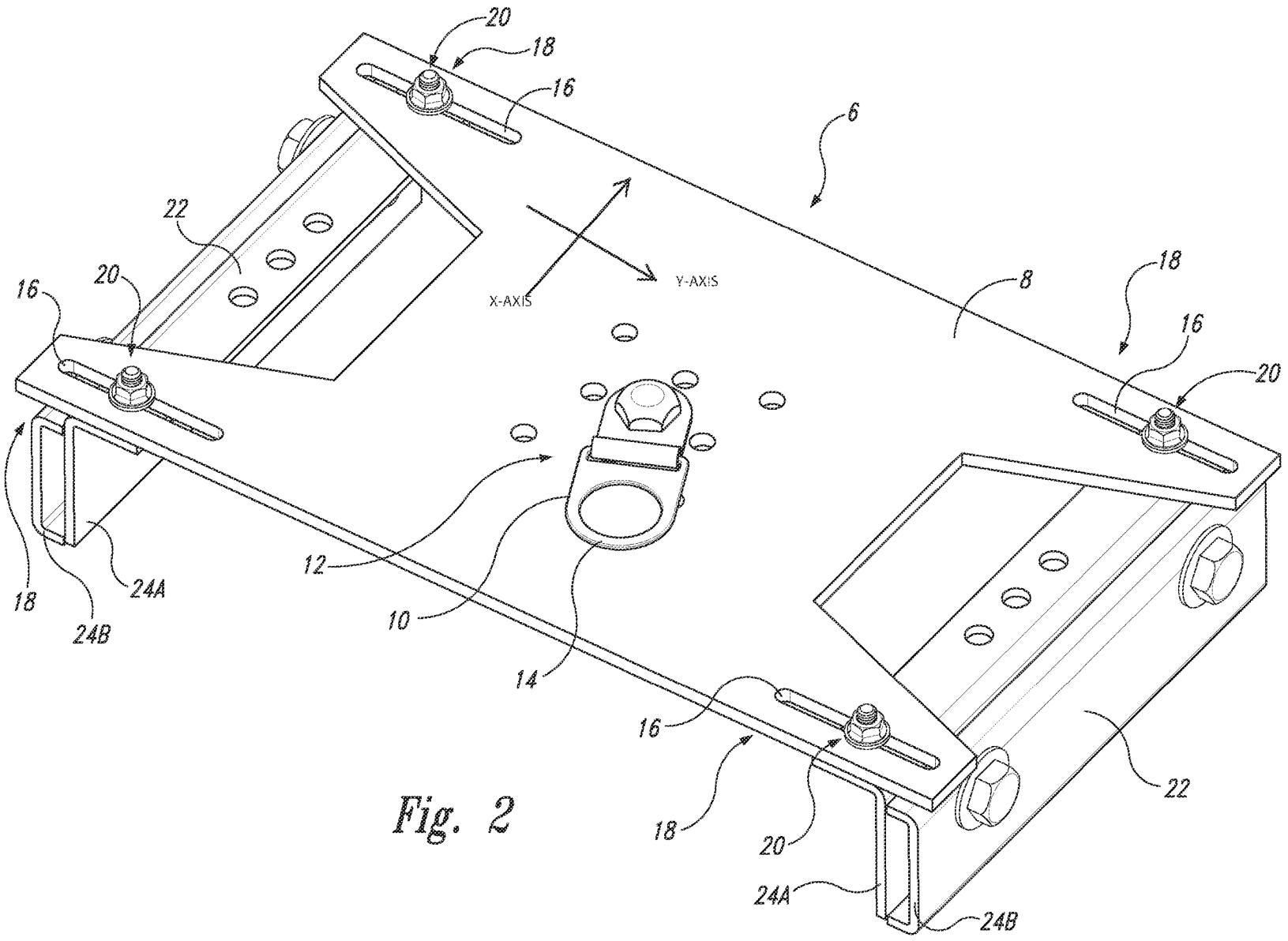
FIG. 2 depicts a top perspective view of an exemplary roof attachment system as discussed herein.

Turning to a further discussion of the figures, in some aspects, the present systems, devices and methods, etc., provide roof attachment systems configured for attaching a personal fall protection anchorage device to at least two standing seams on a roof. FIG. 2 depicts a top perspective view of an exemplary roof attachment system 6 as discussed herein. Briefly, roof attachment system 6 comprises retention plate 8, which is configured to hold a personal fall protection anchorage device 10, such as the depicted D-ring connector 14, to a central portion 12 of the retention plate 8. D-ring connector 14 is configured to hold a personal fall protection anchorage device such as a lifeline.

Retention plate 8 has an x-axis and a y-axis wherein the x-axis runs the same direction as the standing seams and the y-axis runs transverse to the standing seams. The retention plate 8 further comprises spacing elements 18 configured to allow the retention plate 8 to be attached to standing seams having varying distances between each other, for example standing seams present on different roofs. In the embodiment in FIG. 3, the spacing elements 18 comprise at least two y-axis spaced-apart slots 16, wherein each y-axis spaced-apart slot is configured to immobily hold at least one retention plate connector 20 attached to a standing seam grasper 22, each y-axis spaced-apart slot 16 configured to immobily hold the retention plate connector 20 at a plurality of locations within y-axis spaced-apart slot 16.

Typically, at least two of the retention plate connectors 20 are each configured to immobily attach at least one standing seam grasper 22 to the retention plate 8 via the y-axis spaced-apart slots 8. Also typically, the standing seam graspers 22 each comprise at least two opposed grasping elements 24A, 24B sized and configured to immobily squeeze a standing seam of a roof between them.

Figure 3:
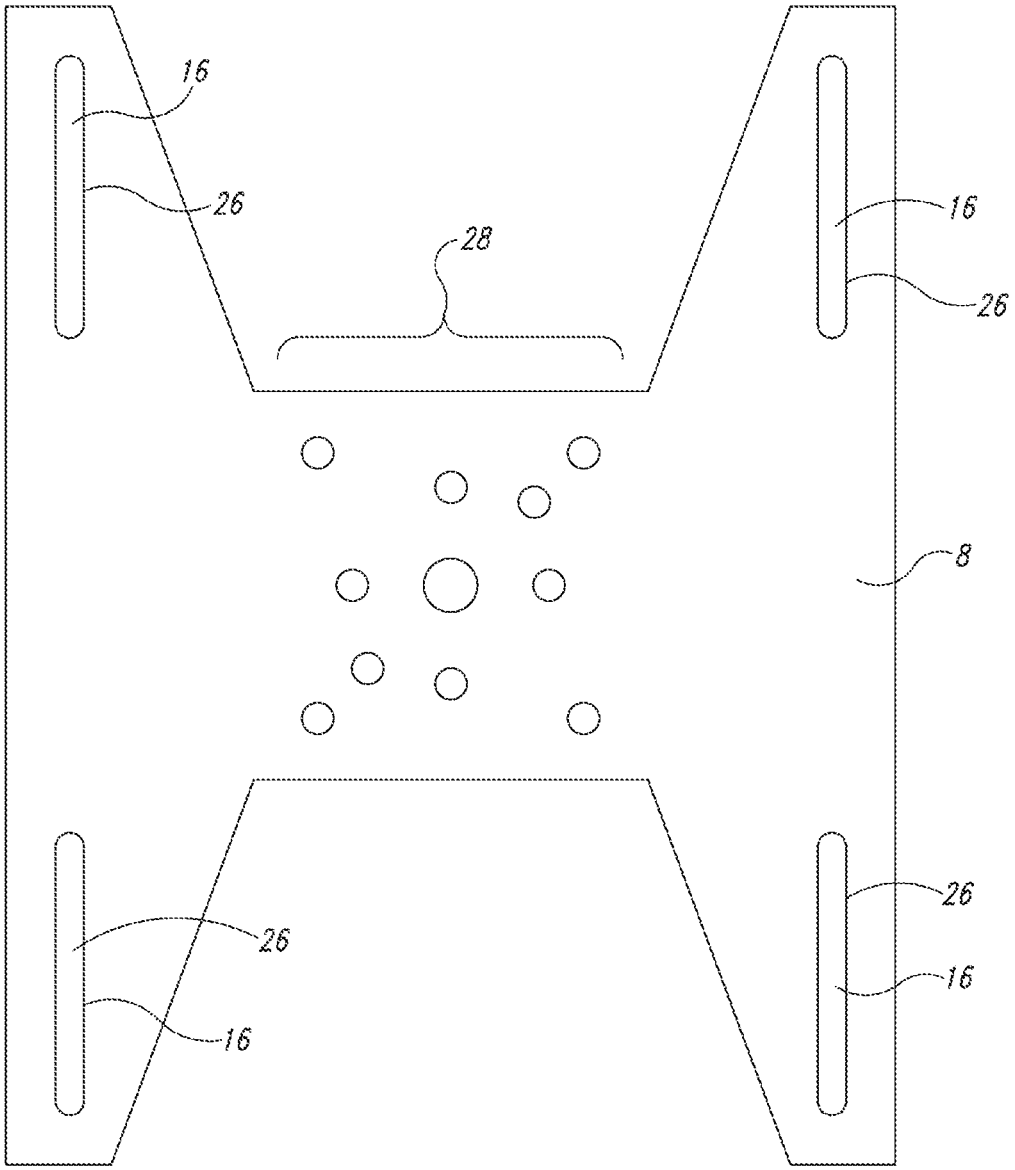
FIG. 3 depicts a top plan view of an exemplary retention plate suitable for use with the roof attachment systems as discussed herein.
Figure 4A:
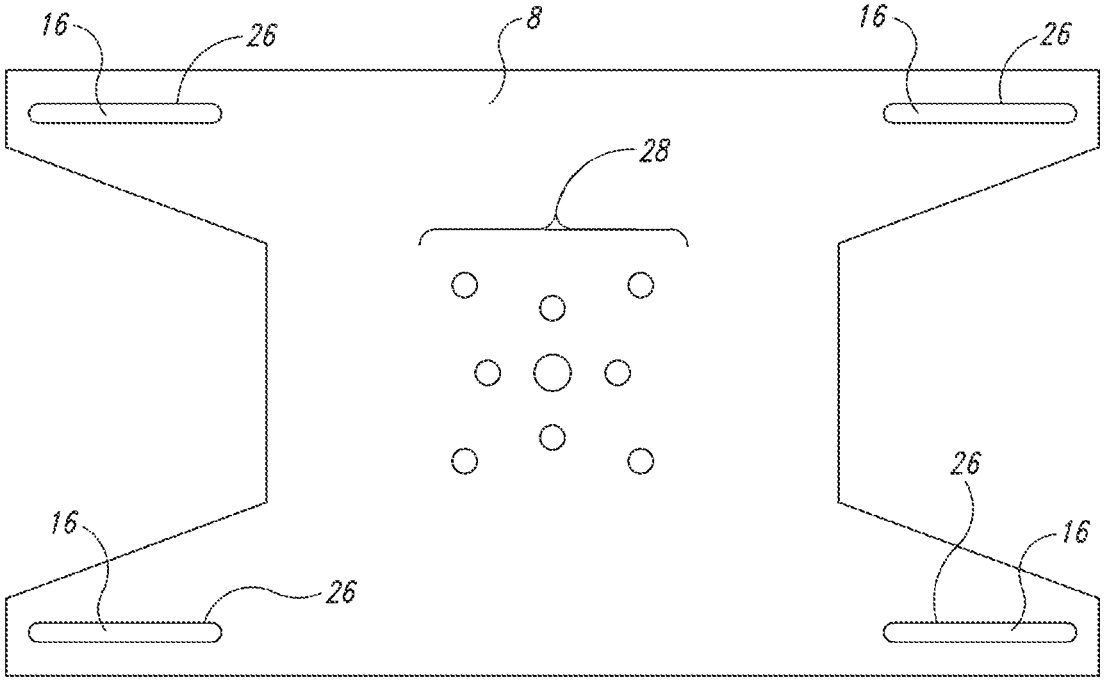
FIGS. 4A-4C depict a top plan view and side plan views of an exemplary retention plate suitable for use with the roof attachment systems as discussed herein wherein exemplary dimensions for such plate are provided.
Figure 4B:
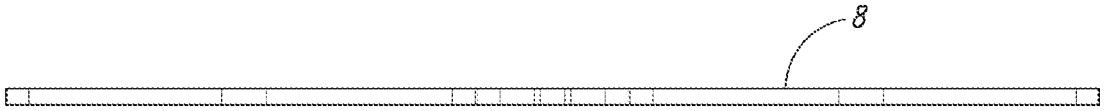
Figure 4C:
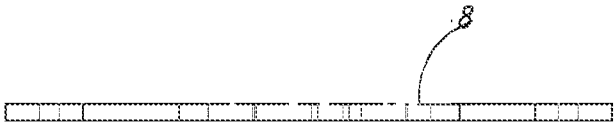

FIG. 3 depicts a top plan view of an exemplary retention plate 8 suitable for use with the roof attachment systems 6 as discussed herein. FIGS. 4A-4C depict a top plan view and side plan views of an exemplary retention plate 8 suitable for use with the roof attachment systems 6 as discussed herein wherein exemplary dimensions for such retention plate 8 are provided. These examples, y-axis spaced-apart slots 16, which can be a single, continuous slot or otherwise as desired, are provided as a pair of sub-slots 26, each of sub-slots 26 configured to slidingly receive a single retention plate connector 20 attached to a standing seam grasper 22, typically allowing the standing seam grasper 22 to slide within the sub-slot 26 until such time as a user desired to immobily secure the standing seam grasper 22 with the sub-slot 26.

The roof attachment system 6 is configured to hold the personal fall protection anchorage device 10 to a central portion 12 of the retention plate 8. In FIGS. 3-4C, the central portion 12 comprises a plurality of anchor retention holes 28 or other attachment points for the personal fall protection devices 10, which can be D-rings 14 or attachment posts or otherwise as desired. As discussed above, roof attachment system 8 has an x-axis and a y-axis wherein the x-axis runs the same direction as the standing seams of the roof and the y-axis runs transverse to the standing seams, for example at 90° from the y-axis. In certain embodiments, the retention plate 8 further can comprise at least two y-axis spaced-apart slots 16, each y-axis spaced-apart slot 16 configured to immobily hold at a retention plate connector 20 attached to a standing seam grasper 22, with each y-axis spaced-apart slot 16 also configured to immobily hold the retention plate connector 20 at a plurality of locations within the slot. In some embodiments, such as in the cited figures, each y-axis spaced-apart slot 16 comprises two sub-slots 26, usually running along a single line along the y-axis. The roof attachment system 6 also comprises at least two of the retention plate connectors 20 configured to immobily attach at least one standing seam grasper 22 to the retention plate 8 via the y-axis spaced-apart slots 16.

Figure 5:
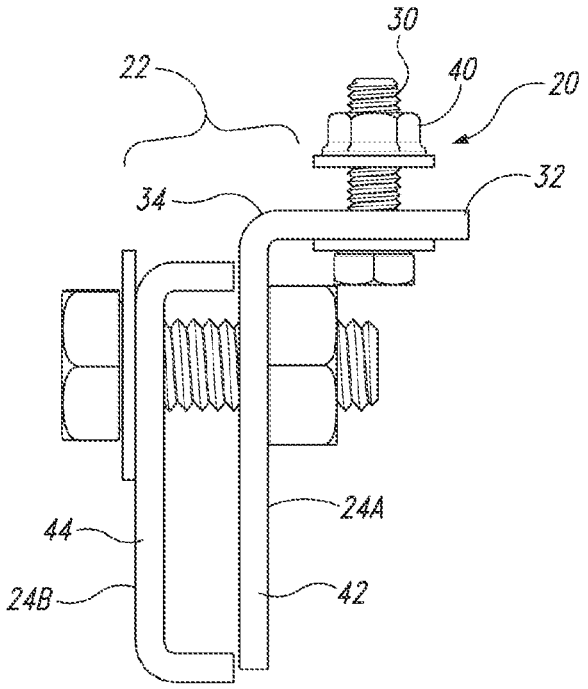
FIG. 5 depicts a side plan view of a standing seam grasper suitable for use with the roof attachment systems as discussed herein.
Figure 6:
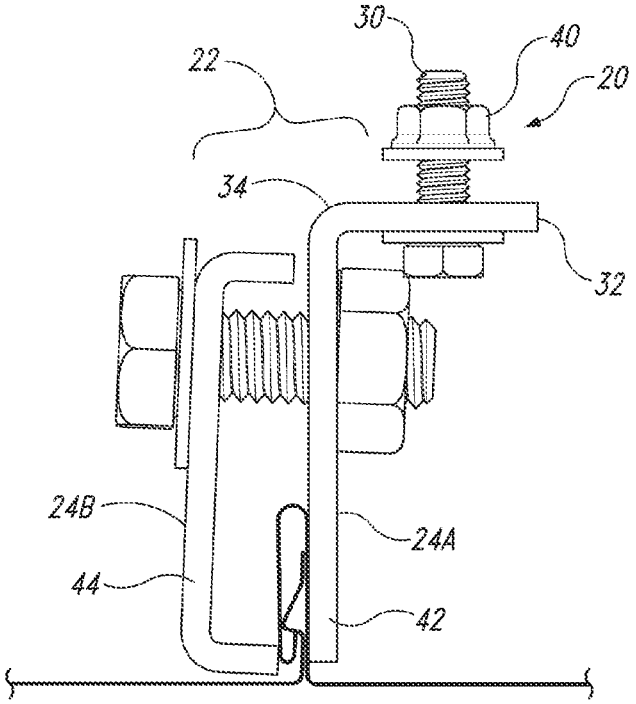
FIG. 6 depicts a side plan view of a standing seam grasper suitable for use with the roof attachment systems as discussed herein, in place along a standing seam.
Figure 7:
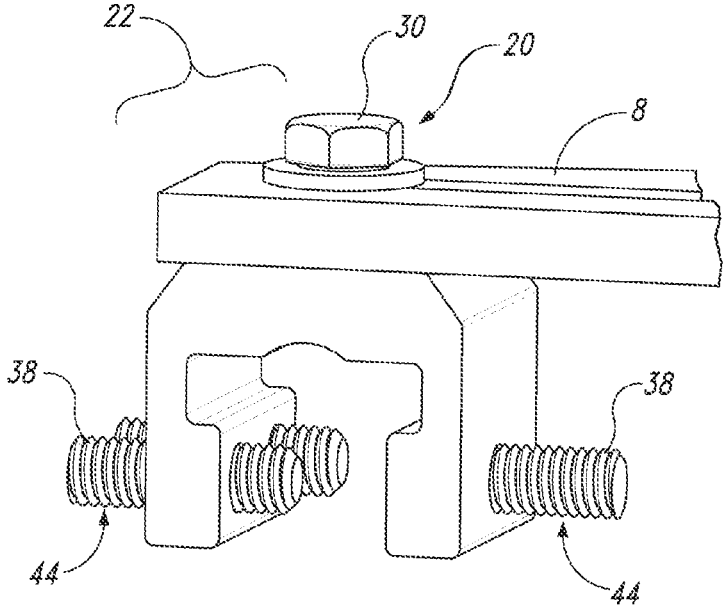
FIG. 7 depicts a side plan view of a standing seam grasper having an alternative configuration suitable for use with the roof attachment systems as discussed herein.

FIGS. 5-7 show exemplary standing seam graspers 22 suitable for use with the roof attachment systems 8 as discussed herein. In FIGS. 5-6, the retention plate connector 20 is the vertical bolt 30 pointing upward and extending through the upper (first) leg 32 of the L-shaped element 34 of the grasping element 24A, while in FIG. 7 the retention plate connector 20 is the vertical bolt 30 pointing downward through retention plate 8 and into U-shaped standing seam grasper 36. In FIG. 7, the squeezing elements that clamp onto the standing seam are the opposed bolts 38, which can be screwed in and out to grasp and release the standing seam. The retention plate connector 20 in FIG. 7 can be referred to as a RCT clamp system.

Exemplary standing seam width compatibility include the following (in inches; "SSC" indicates "standing seam clamp" position):

| | BasePlate Model | | | | | |
|---|---|---|---|---|---|---|
| | 12 × 18 | | 14 × 22 | | 18 × 24 | |
| Clamp Position | Min. | Max. | Min. | Max. | Min. | Max. |
| SSC Standard | 10½" | | 14½" | | 18.0" | |
| SSC Inverted | 8½" | 18½" | 12½" | 23.0" | 16.0" | 26½" |
| RCT Clamp | | 17.0" | | 20¾" | | 24¼" |

Other connector elements and configurations can be used so long as the retention plate (and therefore the attached personal fall protection device) are securely, immobily attached to the standing seams.

The roof attachment system 6 also comprises at least two of the standing seam graspers 22, which are also shown in FIGS. 5-7. In FIGS. 5-6, each of the standing seam graspers 22 comprises at least two opposed grasping elements 24A, 24B sized and configured to immobily squeeze a standing seam of a roof. In FIG. 7, the opposed grasping elements are the opposed bolts 38.

In the exemplary embodiments discussed above, the retention plate connectors 20 comprise vertical bolts 30 and in some embodiment corresponding nuts 40. Returning to the embodiment in FIGS. 5-6 the at least two standing seam graspers 22 each comprise a) an L-shaped element 34 wherein a first leg 32 of the L-shape abuts the retention plate 8 and a second leg 42 of the L-shape can be configured to abut the standing seam, and b) a squeezing element 44 spaced apart from the first leg such that the L-shaped element and the squeezing element 44 can be sized and configured to immobily squeeze the standing seam between them. In FIG. 7, the squeezing elements 44 comprise opposed bolts, while in FIGS. 5-6 the squeezing elements 44 comprise a shallow U-shape comprising a central portion and two legs extending therefrom. The squeezing elements can be disposed such that free ends of the two legs of the U-shaped elements contact the L-shaped element and/or the standing seam.

Speaking generally, the retention plate 8 can comprise a D-ring configured to hold the personal fall protection anchorage device. The at least two y-axis spaced-apart slots each comprise a pair of sub-slots, each configured to slidingly receive a single retention plate 8 connector attached to a standing seam grasper 22. The retention plate 8 can be H-shaped and the at least two y-axis spaced-apart slots can be located in the legs of the H-shape.

In some further embodiments, the systems, etc., herein provide personal fall protection system configured for attaching a personal fall protection anchorage device to a roof, the personal fall protection system can comprise the roof attachment system 6*s* herein and further comprise at least two standing seams of the roof immobily held within the opposed grasping elements 24A, 24B. The roof can be a metal roof, and the personal fall protection system further can comprise a personal fall protection anchorage device attached to the roof attachment system 6.

Methods herein including manufacturing and/or using the roof attachment system 6*s* herein as well as the personal fall protection systems herein.

Figure 8:
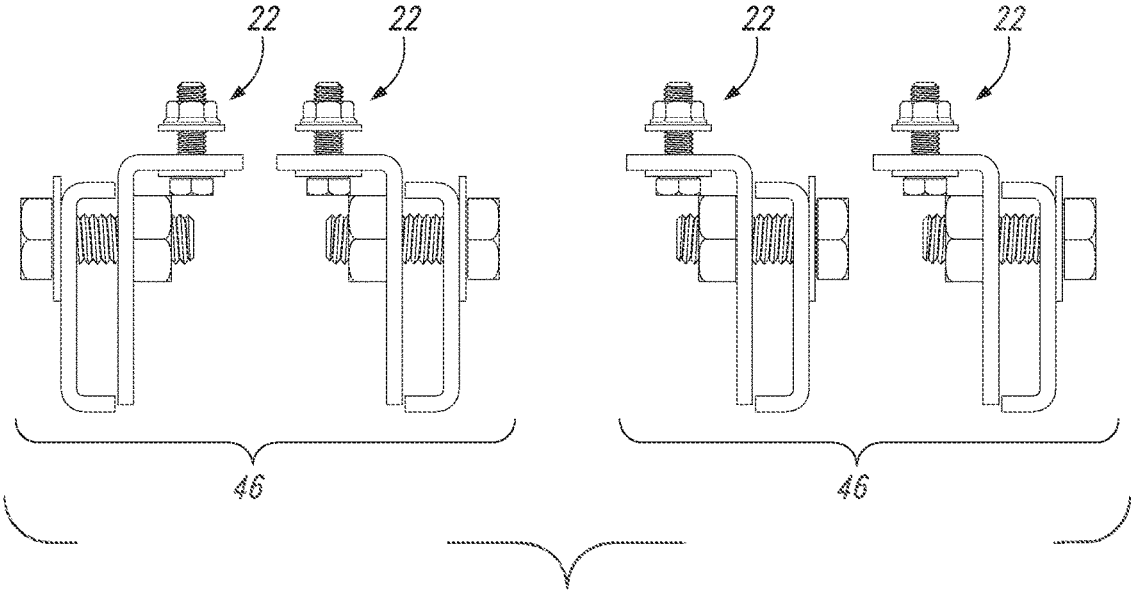
FIG. 8 depicts side plan views of left and right standing seam grasper couplets suitable for use with the roof attachment systems as discussed herein.

The following provide additional embodiments, examples, etc., of the various systems, devices, elements, etc., herein:

FIG. 8 depicts side plan views of couplets 46 of left and right standing seam grasper 22 suitable for use with the roof attachment systems as discussed herein, showing different exemplary configurations for such couplets 46.

Figure 9:
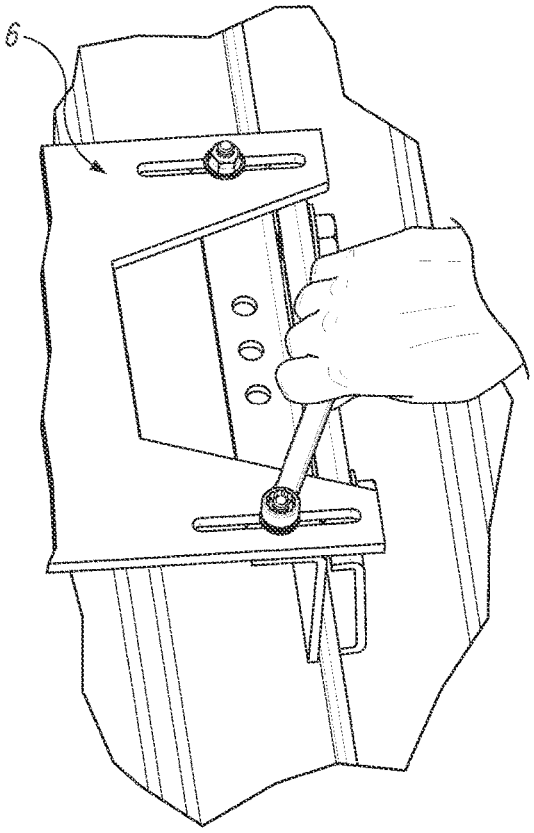
FIG. 9 depicts a top perspective view of an exemplary roof attachment system as discussed herein being bolted into place along a standing seam.

FIG. 9 depicts a top perspective view of an exemplary roof attachment system as discussed herein being bolted into place along a standing seam.

Figure 10:
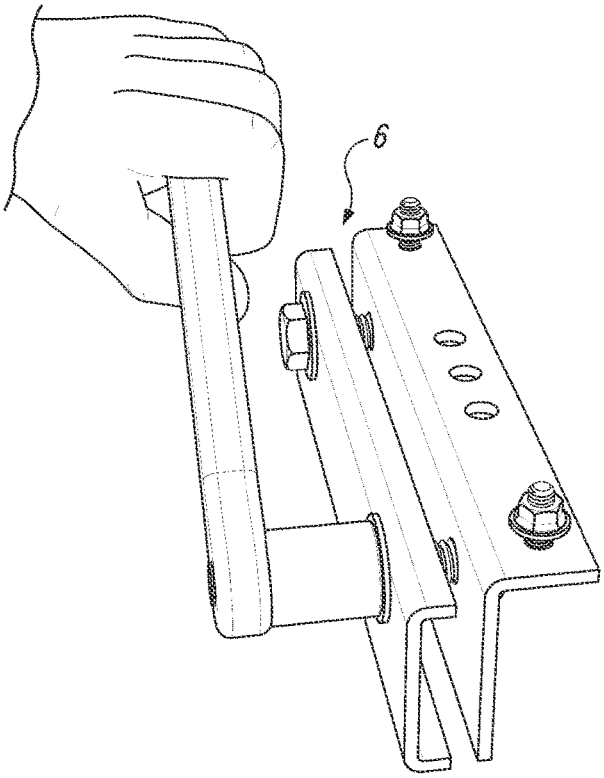
FIG. 10 depicts a side perspective view of an exemplary roof attachment system as discussed herein being bolted together (standing seam not shown in FIG. 10).

FIG. 10 depicts a side perspective view of an exemplary roof attachment system 8 as discussed herein being bolted together (standing seam not shown in FIG. 10).

FIG. 11 depicts a top perspective view of an exemplary roof attachment system as discussed herein with an exemplary personal protection equipment anchor 48 and lifeline 50 attached. In the embodiments in FIG. 11, the personal protection equipment anchor 48 is a D-ring connector 14.

FIG. 12 depicts a top perspective view of an exemplary roof attachment system 6 as discussed herein with an alternative exemplary personal protection equipment anchor 48 and lifeline 50 attached.

FIG. 13 depicts a top plan view of exemplary personal protection equipment (PPE) anchors 48 suitable for use with the roof attachment systems 8 as discussed herein. The embodiments in FIG. 13 include a vertical loop 52, a horizontal loop 54, a pass-through open-loop 56, and a D-ring connector 14. These embodiments also depict various embodiments for connecting such personal protection equipment anchors 48 to the central portion 12 of the retention plate 8.

All terms used herein are used in accordance with their ordinary meanings unless the context or definition clearly indicates otherwise. Also unless expressly indicated otherwise, in the specification the use of "or" includes "and" and vice-versa. Non-limiting terms are not to be construed as limiting unless expressly stated, or the context clearly indicates, otherwise (for example, "including," "having," and "comprising" typically indicate "including without limitation"). Singular forms, including in the claims, such as "a," "an," and "the" include the plural reference unless expressly stated, or the context clearly indicates, otherwise.

Unless otherwise stated, adjectives herein such as "substantially" and "about" that modify a condition or relationship characteristic of a feature or features of an embodiment, indicate that the condition or characteristic is defined to within tolerances that are acceptable for operation of the embodiment for an application for which it is intended.

The scope of the present devices, systems and methods, etc., includes both means plus function and step plus function concepts. However, the claims are not to be interpreted as indicating a "means plus function" relationship unless the word "means" is specifically recited in a claim, and are to be interpreted as indicating a "means plus function" relationship where the word "means" is specifically recited in a claim. Similarly, the claims are not to be interpreted as indicating a "step plus function" relationship unless the word "step" is specifically recited in a claim, and are to be interpreted as indicating a "step plus function" relationship where the word "step" is specifically recited in a claim.

From the foregoing, it will be appreciated that, although specific embodiments have been discussed herein for purposes of illustration, various modifications may be made without deviating from the spirit and scope of the discussion herein. Accordingly, the systems and methods, etc., include such modifications as well as all permutations and combinations of the subject matter set forth herein and are not limited except as by the appended claims or other claim having adequate support in the discussion and figures herein.

What is claimed is:

1. A roof attachment system configured for attaching a personal fall protection anchorage device to at least two standing seams on a roof, the roof attachment system comprising:

a retention plate configured to hold the personal fall protection anchorage device to a central portion of the retention plate and having an x-axis and a y-axis wherein the x-axis runs the same direction as the standing seams and the y-axis runs transverse to the standing seams, the retention plate further comprising at least two y-axis, spaced-apart slots, wherein the y-axis, spaced-apart slots run the same direction as the y-axis and transverse to the x-axis, each y-axis, spaced-apart slot configured to immobily hold a retention plate connector attached to a standing seam grasper, each y-axis spaced-apart slot configured to immobily hold the retention plate connector at a plurality of locations within the slot;

at least two of the retention plate connectors configured to immobily attach at least two standing seam graspers to the retention plate via at least two y-axis, spaced-apart slots, each of the at least two y-axis, spaced-apart slots retaining at least one of the standing seam graspers;

at least two of the standing seam graspers each comprising at least two opposed grasping elements sized and configured to immobily squeeze a standing seam of a roof, and wherein the y-axis, spaced-apart slots are long enough such that the standing seam graspers can be adjusted to attach the roof attachment system to at least a first pair of standing seams and a second different pair of standing seams wherein a distance difference between a) a first width between the first pair of standing seams and b) a second width between the second pair of standing seams is at least about 4".

2. The system of claim 1 wherein the retention plate comprises a D-ring configured to hold the personal fall protection anchorage device.

3. The system of claim 1 wherein the at least two y-axis spaced-apart slots each comprise a pair of sub-slots, each configured to slidingly receive a single retention plate connector attached to a standing seam grasper.

4. The system of claim 1 wherein the retention plate is H-shaped and the at least two y-axis spaced-apart slots are located in the legs of the H-shape.

5. The system of claim 4 wherein the retention plate connectors comprise nuts and bolts.

6. The system of claim 1 wherein the at least two standing seam graspers each comprise a) an L-shaped element wherein a first leg of the L-shape abuts the retention plate and a second leg of the L-shape is configured to abut the standing seam, and b) a squeezing element spaced apart from the first leg such that the L-shaped element and the squeezing element are sized and configured to immobily squeeze the standing seam between them.

7. The system of claim 6 wherein the squeezing element comprises a shallow U-shape comprising a central portion and two legs extending therefrom, and the squeezing element is disposed such free ends of the two legs contact the L-shaped element and/or the standing seam.

8. A personal fall protection system configured for attaching a personal fall protection anchorage device to a roof, the personal fall protection system comprising the roof attachment system of claim 1 and further comprising at least two standing seams of the roof immobily held within the opposed grasping elements.

9. The personal fall protection system of claim 8 wherein the roof is a metal roof.

10. The personal fall protection system of claim 9 wherein the personal fall protection system further comprises a personal fall protection anchorage device attached to the roof attachment system.

11. The personal fall protection system of claim 8 wherein the personal fall protection system further comprises a personal fall protection anchorage device attached to the roof attachment system.

* * * * *